US005087862A

United States Patent [19]

Mita et al.

[11] Patent Number: 5,087,862

[45] Date of Patent: Feb. 11, 1992

[54] DISCHARGE LAMP LIGHTING APPARATUS FOR CONTROLLING VOLTAGE OF SWITCHING TRANSISTOR BY RAISING STARTING VOLTAGE

[75] Inventors: Kazutoshi Mita; Keiichi Shimizu, both of Yokohama, Japan

[73] Assignee: Toshiba Lighting and Technology Corporation, Tokyo, Japan

[21] Appl. No.: 443,491

[22] Filed: Nov. 30, 1989

[30] Foreign Application Priority Data

Nov. 30, 1988 [JP] Japan ..... 63-302393

[51] Int. Cl.[5] ..... H05B 37/02

[52] U.S. Cl. ..... 315/289; 315/219; 315/DIG. 7

[58] Field of Search ..... 315/289, 219, DIG. 7, 315/149, 151, 159, 307

[56] References Cited

U.S. PATENT DOCUMENTS

| | | | |
|---|---|---|---|
| 4,339,695 | 7/1982 | Siglock | 315/289 |
| 4,403,173 | 9/1983 | Mayer | 315/289 |
| 4,495,446 | 1/1985 | Brown | 315/289 |
| 4,587,460 | 5/1986 | Murayama | 315/174 |
| 4,803,406 | 2/1989 | Yasuda | 315/DIG. 7 |
| 4,881,011 | 11/1989 | Britton | 315/289 |
| 4,992,702 | 2/1991 | Shimizu | 315/307 |

*Primary Examiner*—Eugene R. LaRoche
*Assistant Examiner*—Amr Zarabian
*Attorney, Agent, or Firm*—Cushman, Darby & Cushman

[57] ABSTRACT

A discharge lamp lighting apparatus of this invention includes an inverter circuit and a control circuit connected to a power source rectifier for supplying a D.C. voltage. The inverter circuit includes a parallel voltage resonance circuit of an output transformer and a resonance capacitor and the output side of the output transformer is connected to a discharge lamp and a timer circuit. The inverter circuit further includes a switching transistor for switching the D.C. power source and a voltage detection circuit for detecting a voltage $V_{CE}$ between the collector and emitter of the switching transistor. In the start-up operation of the discharge lamp, the control circuit raises the control level of $V_{CE}$ of the switching transistor so as to set the output voltage of the inverter circuit high until it receives a signal which is output after a preset time determined by the timer circuit has elapsed, and under this condition, the discharge lamp is started.

8 Claims, 4 Drawing Sheets

DISCHARGE LAMP LIGHTING APPARATUS FOR CONTROLLING VOLTAGE OF SWITCHING TRANSISTOR BY RAISING STARTING VOLTAGE

BACKGROUND OF THE INVENTION

1. Field of the Invention

This invention relates to a discharge lamp lighting apparatus, and more particularly, to a discharge lamp lighting apparatus for controlling a voltage of a switching transistor by increasing the output voltage when switching the apparatus on without excessively raising the output voltage during the lighting operation.

2. Description of the Related Art

Conventionally, a voltage resonance type inverter as described below is known as an inverter for converting D.C. power to A.C. power. The inverter of this type includes a parallel voltage resonance circuit and a switching element for turning on and off an input D.C. voltage at high frequencies, for example, 20 to 100 KHz which is higher than the audio frequency and then applying the input D.C. voltage to the voltage resonance circuit. An A.C. voltage induced in the voltage resonance circuit is applied to a load. In the conventional voltage resonance type inverter, the operation frequency (ON/OFF frequency of the switching element) is not controlled. Therefore, the operation frequency in separately excited inverters is generally set constant and the operation frequency of self-excited inverters varies according to the load to be supplied with the A.C. voltage. Such an inverter technology is disclosed in detail in Japanese Patent Publication No. 57-45040, Japanese Patent Disclosure No. 61-2299 and Japanese Utility Model Disclosure No. 62-69396.

In the above inverter, a voltage applied to the switching element varies according to the condition of the load to be supplied with the A.C. voltage. Therefore, the voltage applied to the switching element tends to be excessively high in the inverter in which the load such as a discharge lamp load significantly varies. In order to prevent the switching element from being damaged due to the excessively high voltage, it is necessary to use an expensive switching element having a high withstanding voltage.

A discharge lamp lighting apparatus using an inverter having a switching transistor whose collector-emitter voltage is set to a constant level has been provided (U.S. patent application Ser. No. 284,377). In the discharge lamp lighting apparatus of the above type using a self-excited inverter, a parallel resonance circuit including a primary winding or a secondary winding of the output transformer is coupled at one end to the collector of the switching transistor acting as the switching element and coupled at the other end to the positive terminal of a D.C. power source. Further, a peak voltage detection circuit is coupled between the collector and emitter of the switching transistor and a control circuit having a transistor for an error detector is coupled between the base and emitter thereof. The peak voltage detection circuit is coupled between the negative terminal of the D.C. power source and the control circuit.

In the above discharge lamp lighting apparatus, the collector-emitter voltage of the switching transistor is detected by the peak voltage detection circuit. When the collector-emitter voltage of the switching transistor rises, the potential at a preset detection point of the peak voltage detection circuit rises. Then, time during which the base current of the switching transistor flows via the control circuit becomes short and the ON-time period of the switching transistor becomes short. As a result, energy stored in the primary winding of the output transformer is reduced so that the outputs of the resonance circuit and the output transformer will be lowered.

In contrast, when the collector-emitter voltage of the switching transistor is lowered, the control which is the opposite of that effected in the case where the collector-emitter voltage rises is effected. More specifically, when the collector-emitter voltage of the switching transistor is lowered, the potential at the preset detection point of the peak voltage detection circuit is lowered. Then, the base current of the switching transistor flows via the control circuit for a longer period of time and the ON-time period of the switching transistor becomes longer. As a result, energy stored in the primary winding of the output transformer is increased so that the outputs of the resonance circuit and the output transformer will be increased.

In this way, the collector-emitter voltage of the switching transistor is controlled to a constant level by effecting the negative feedback control in the conventional circuit.

The conventional apparatus in which the collector-emitter voltage of the switching transistor is controlled to a constant level at the starting time and lighting time for the discharge lamp has the following problem. That is, the collector-emitter voltage of the switching transistor and the output voltage of the inverter may be controlled to a constant level at the starting time and lighting time. However, in order to light the discharge lamp, it is necessary to raise the starting voltage or ignition voltage of the discharge lamp, and therefore it becomes difficult to start the discharge lamp when the output voltage thereof is set at a low level. In contrast, if the output voltage is set at a high level, an excessive voltage will be applied in the lighting operation of the discharge lamp. For this reason it becomes necessary to use a large ballast in order to cope with the above problem.

SUMMARY OF THE INVENTION

Accordingly, an object of this invention is to provide a discharge lamp lighting apparatus for controlling the collector-emitter voltage of switching transistor to a constant level by increasing the ignition voltage or starting voltage without excessively raising the output voltage during the lighting operation.

According to an aspect of the present invention, there is provided a discharge lamp lighting apparatus comprising means for supplying a D.C. voltage; switching means for switching a voltage from the D.C. voltage supplying means; voltage resonance circuit means including an inductor and a resonance capacitor connected at a connection point in series with the switching means across the D.C. voltage supplying means; voltage detection means connected to the connection point, for detecting a voltage of the switching means at the connection point; and control means for raising the voltage of the switching means to a preset constant level in a constant period of time from the time at which the D.C. voltage supplying means is turned on until the discharge lamp is lit and setting the voltage of the switching means detected by the voltage detection means to a constant level, which is lower than the preset level, after the discharge lamp is lit.

BRIEF DESCRIPTION OF THE DRAWINGS

The aforementioned aspect and other features of the present invention are explained in the following description, taken in connection with the accompanying drawings wherein.

DETAILED DESCRIPTION OF THE PREFERRED EMBODIMENTS

There will now be described a discharge lamp lighting apparatus according to one embodiment of this invention.

Figure 1:
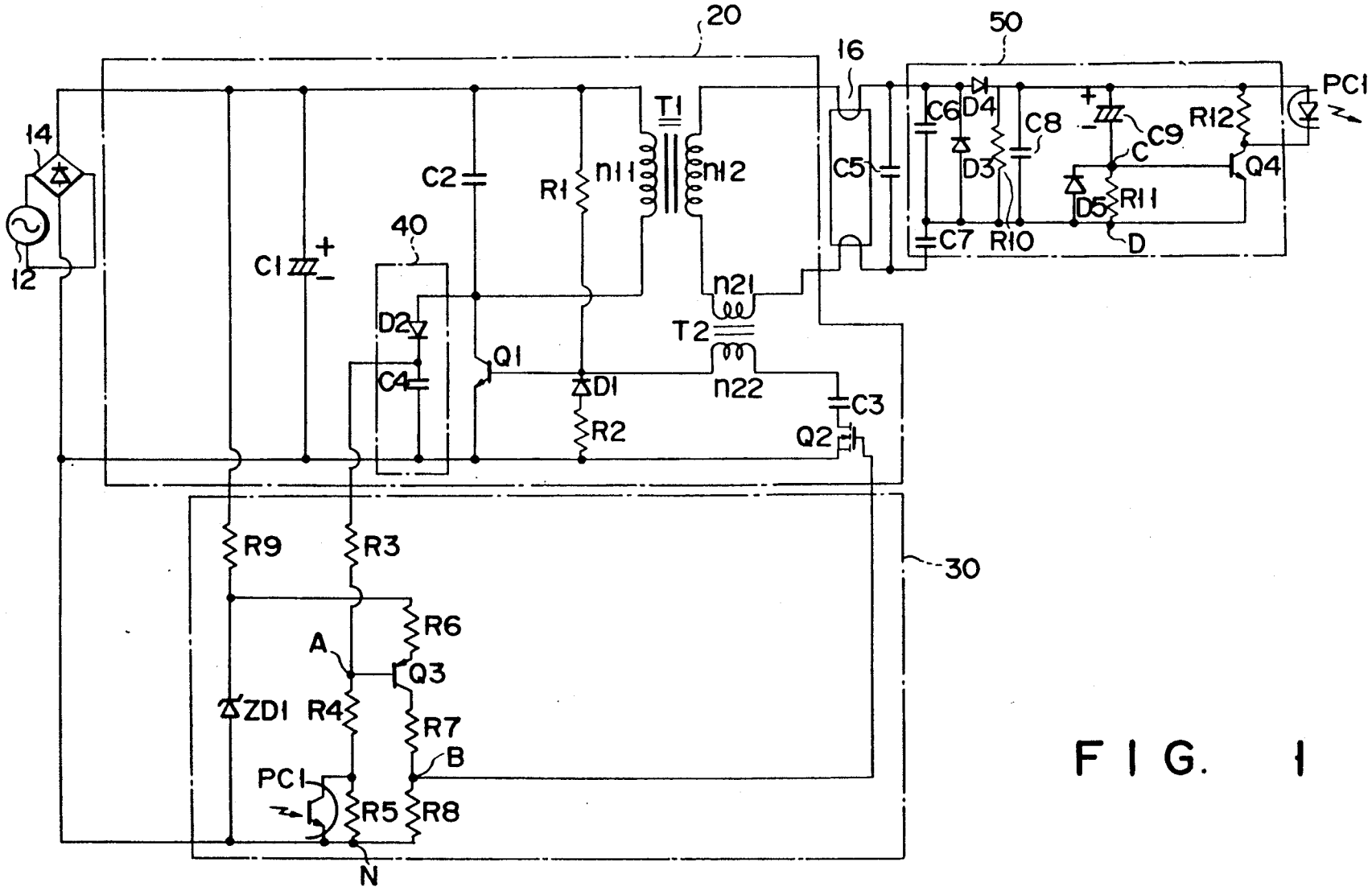
FIG. 1 is a circuit diagram showing the construction of a discharge lamp lighting apparatus using an inverter according to on embodiment of this invention.

FIG. 1 is a circuit diagram showing the construction of a discharge lamp lighting apparatus according to one embodiment of this invention. As shown in FIG. 1, a commercial power source 12 is coupled to a power source rectifier 14 to form a power source circuit. The power source rectifier 14 is coupled to an inverter circuit 20 and a control circuit 30 which will be described in detail later.

In the inverter circuit 20, a smoothing capacitor C1 is coupled to the power source rectifier 14 as shown in FIG. 1. The positive electrode of the smoothing capacitor C1 is coupled to the collector of a switching transistor Q1 via a primary winding n11 of a transformer T1. The primary winding n11 of the transformer T1 is coupled in parallel with a resonance capacitor C2. The emitter of the switching transistor Q1 is coupled to the negative electrode of the smoothing capacitor C1, and a secondary winding n22 of a saturable transformer T2 having a primary winding n21 coupled to a secondary winding n12 of the transformer T1, a capacitor C3 and a field effect transistor (FET) Q2 are serially coupled between the base and emitter of the transistor Q1 as shown in FIG. 1. Further, a starting resistor R1 is coupled between the positive electrode of the smoothing capacitor C1 and the base of the switching transistor Q1, and a diode D1 and a resistor R2 which constitute a discharging circuit for the capacitor C3 are serially coupled between the base and emitter of the switching transistor Q1 as shown in FIG. 1. A diode D2 with the polarity as shown in FIG. 1 and a capacitor C4 which constitute a detection circuit 40 for detecting a collector-emitter voltage ($V_{CE}$) of the switching transistor Q1 are serially connected between the collector of the switching transistor Q1 and the negative electrode of the smoothing capacitor C1.

A detection output of the detection circuit 40 is supplied to the control circuit 30. That is, a series circuit of resistors R3, R4 and R5 is connected to the connection point between the diode D2 and capacitor C4 of the detection circuit 40. The resistor R5 is connected in parallel with a phototransistor of a photocoupler PC1 and that end (node N) of the resistor R5 which is not connected to the resistor R4 is coupled to the negative electrode of the smoothing capacitor C1. The connection point or node A between the resistors R3 and R4 is connected to the base of the transistor Q3. The emitter and collector of the transistor Q3 are respectively connected to a resistor R6 and a series circuit of resistors R7 and R8. That end of the resistor R8 which is connected to the resistor R7 is connected as a node B to the gate of the transistor Q2 and the other end thereof is connected to the node N. Further, a resistor R9 and a zener diode ZD1 for permitting constant voltage supply are serially connected between the rectified output terminals of the power source rectifier 14. The resistor R6 is connected to the connection point between the resistor R9 and zener diode ZD1.

The secondary winding n12 of the transformer T1 of the inverter circuit 20 is connected to a discharge lamp 16. A capacitor C5 and a series circuit of capacitors C6 and C7 are each connected in parallel with the discharge lamp 16. Further, the capacitor C6 is connected in parallel with the diode D3 with the polarity as shown in FIG. 1. A resistor R10 and a capacitor C8 are each connected in parallel with the diode D3 via a diode D4 with the polarity as shown in FIG. 1. A parallel circuit of a diode D5 with the polarity as shown in FIG. 1 and a resistor R11 is connected across the resistor R10 and capacitor C8 via a node C and a capacitor C9. The positive electrode of the capacitor C9 is coupled to the collector of a transistor Q4 via a parallel circuit of the resistor R12 and a light emitting diode of the photocoupler PC1 and the negative electrode thereof is coupled to the base of the transistor Q4. Further, the emitter of the transistor Q4 is coupled to a connection point (node D) between the capacitors C6 and C7. The capacitors C6, C7, C8 and C9, the diodes D3, D4 and D5, the transistor Q4 and the resistors R10, R11 and R12 constitute timer circuit 50.

Now, the operation of the discharge lamp lighting apparatus with the above construction is explained.

When the power source switch is turned on, the discharge lamp 16 is lit by an output of the transformer T1 of the inverter circuit 20. In the lighting condition, the $V_{CE}$ detection circuit 40 detects the voltage $V_{CE}$ of the switching transistor Q1. When the detected voltage $V_{CE}$ is low, the potential at the node A in the control circuit 40 becomes low. As a result, the base potential of the transistor Q3 is lowered and the collector current becomes large. Therefore, the potential at the node B is raised and the FET Q2 is raised. Then, the apparent capacitance of the capacitor C3 becomes large and the capacitor C3 is fully charged with time delay. As a result, the base current of the transistor Q1 flows for a longer period of time and the ON-time period becomes longer, causing a larger amount of energy to be stored in the primary winding n11 of the output transformer T1. Therefore, the resonance output of the primary winding n11 and the resonance capacitor C2 becomes large, thus controlling the voltage $V_{CE}$ to a constant level.

In contrast, when the voltage $V_{CE}$ detected by the switching transistor Q1 is high, the condition opposite to that in the case where the detected voltage $V_{CE}$ is low is set. That is, when the voltage $V_{CE}$ becomes high, the potential at the node A in the control circuit 30 is raised. As a result, the base potential of the transistor Q3 becomes high and the collector current becomes small. Therefore, the potential of the node B is lowered and the gate potential of the FET Q2 becomes low, thereby reducing the apparent capacitance of the capacitor C3. As a result, the base current of the transistor Q1 flows only for a shorter period of time and the ON-time period becomes shorter, causing a smaller amount of energy to be stored in the primary winding n11 of the output transformer T1. Therefore, the resonance output of the primary winding n11 and the resonance capacitor C2 becomes small, thus controlling the voltage $V_{CE}$ to the constant level.

The start-up operation of the discharge lamp 16 is effected as follows.

At the time of starting the discharge lamp 16, the transistor Q4 is kept ON to activate or turn on the light emitting diode of the photocoupler PC1 while current is flowing into the capacitor C9 of the timer circuit 50 or the potential at the node C is kept at a high level. When the phototransistor of the photocoupler PC1 is turned on in response to light emitted from the light emitting diode, the resistor R5 is short-circuited, causing the potential of the node A to be lowered. As a result, the collector current of the transistor Q3 becomes large, raising the potential of the node B. Then, the apparent capacitance of the capacitor C3 coupled to the FET Q2 becomes large and the collector current of the transistor Q1 becomes larger to increase the output of the output transformer T1. In this way, the discharge lamp 16 is started at a high voltage. As is clear from the Figure, $V_{CE}$ is controlled at constant high level, also in this state.

Figure 2:
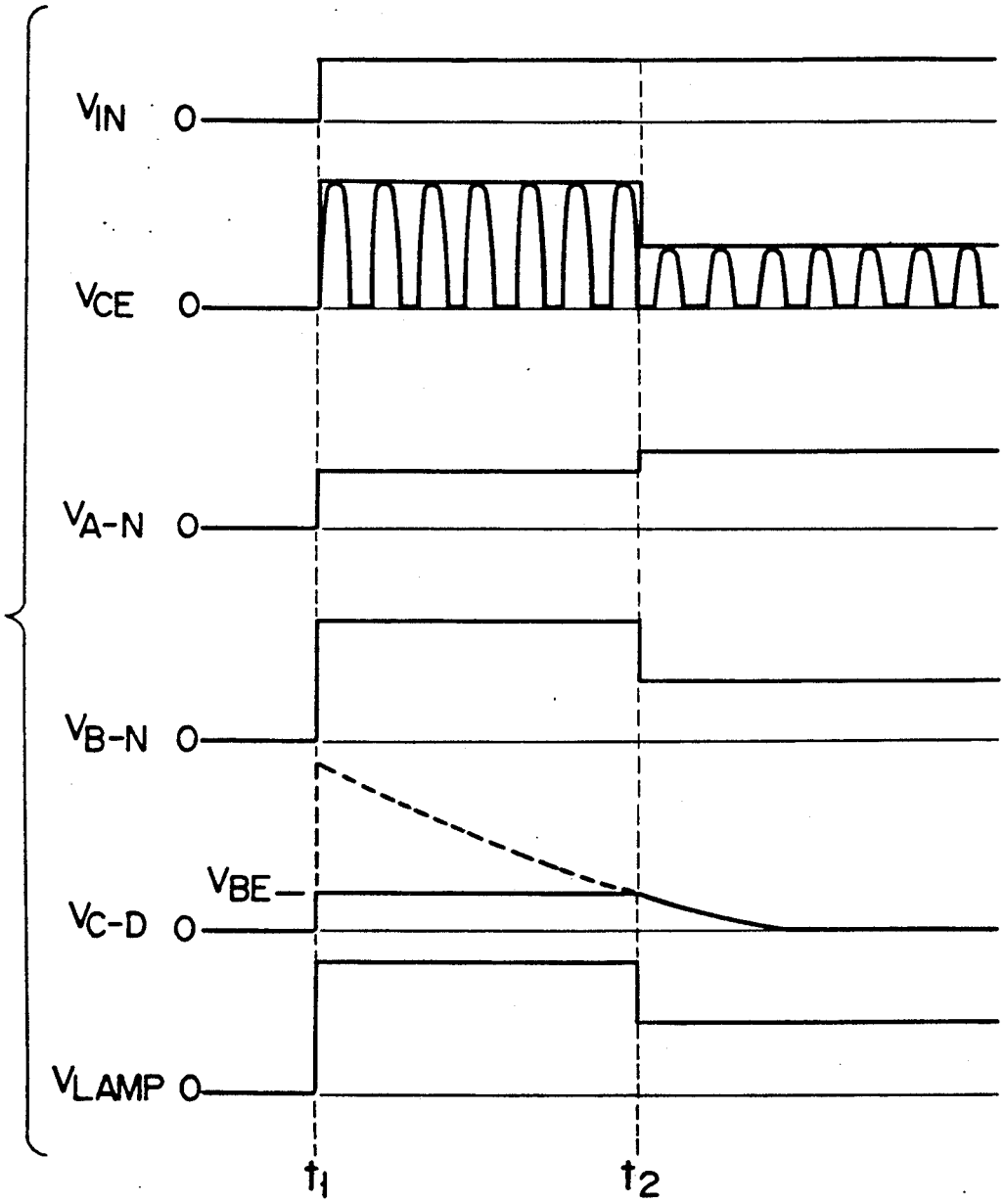
FIG. 2 is a waveform diagram illustrating the operation of the discharge lamp lighting apparatus shown in FIG. 1.

That is, in this embodiment, the control level for controlling the voltage $V_{CE}$ to a constant level is raised by short-circuiting the resistor R5. Assume now that the discharge lamp 16 is not lit. Then, the capacitor C9 of the timer circuit 50 is fully charged when the power source switch is turned on ($t_1$) as shown in FIG. 2. When the charging current is terminated, the transistor Q4 is turned off to deactivate the light emitting diode of the photocoupler PC1 ($t_2$) Thus, the operation of controlling the voltage $V_{CE}$ to the constant level can be attained.

Figure 3:
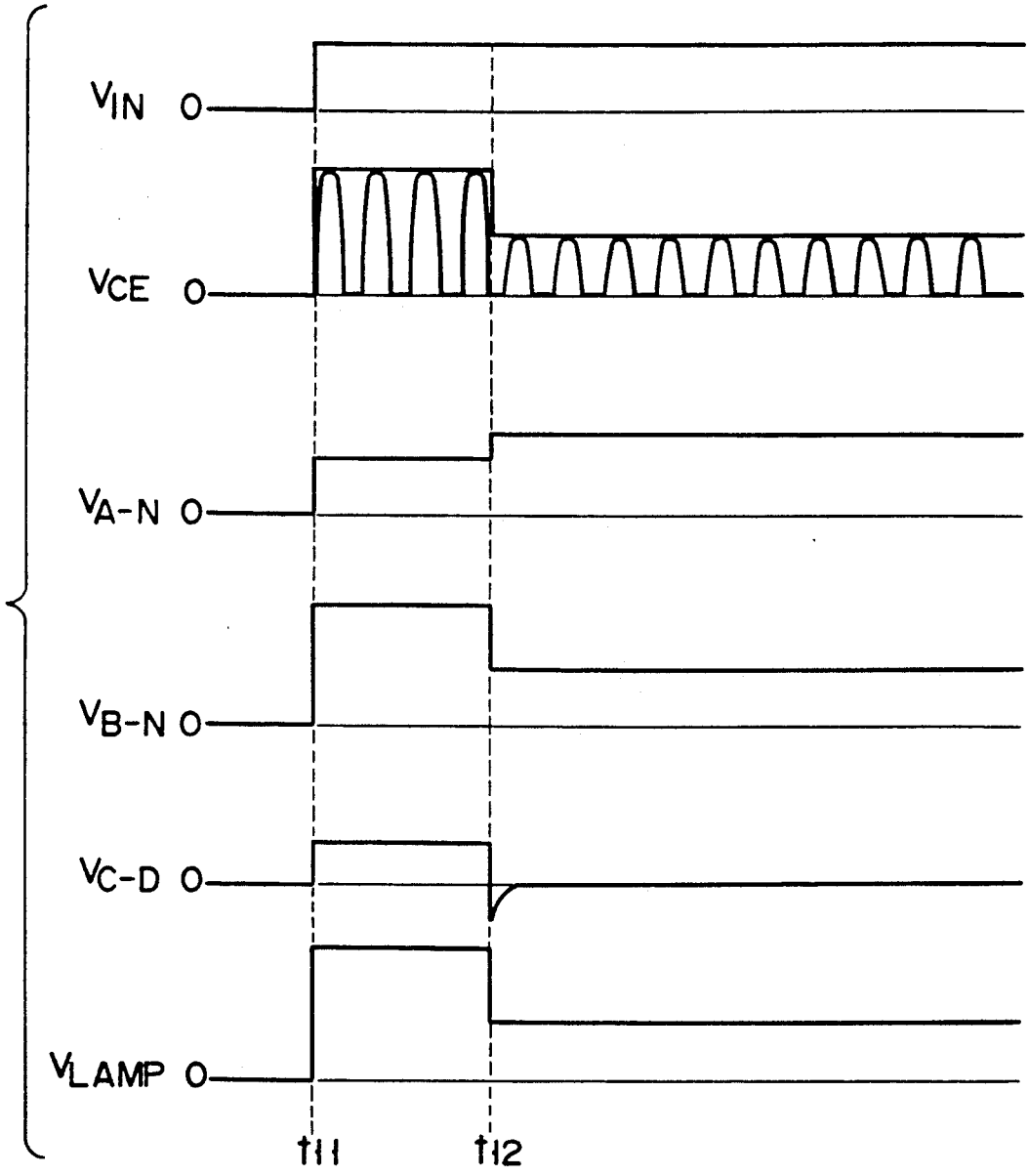
FIG. 3 is another waveform diagram at a different state, illustrating the operation of the discharge lamp lighting apparatus shown in FIG. 1.

In the above embodiment, the operation of controlling the voltage $V_{CE}$ to the preset constant level can be attained when the discharge lamp 16 is lit even if time determined by the timer circuit 50 has not elapsed. That is, as shown in FIG. 3, when the power source switch is turned on ($t_{11}$), charging current flows into the capacitor C9 of the timer 50. At the same time, the voltage $V_{CE}$, voltages between nodes A and N, nodes B and N and nodes C and D and a voltage across the discharge lamp 16 rise as shown in FIG. 3. When the discharge lamp 16 is lit while the capacitor C9 is being charged, the voltage between the nodes C and D is lowered. This is because the voltage across the discharge lamp 16 is lowered from the open-circuit voltage to the lamp voltage and consequently charges on the capacitor C9 are discharged. As a result, charging current for the capacitor C9 is interrupted and the transistor Q4 is turned off to deactivate the light emitting diode of the photocoupler PC1 ($t_{12}$). Further, the potential of the node A becomes high and the potential of the node B becomes low when the discharge lamp 16 is lit. With this construction, the operation of controlling the voltage $V_{CE}$ to the preset constant level can be attained at the same time of light-up of the discharge lamp 16. Further, unlike the case where an independent timer is used for lighting a lamp, variation in the light output, i.e., the light output becomes high until the operation of the timer is completed after the light is lit, and the light output varies regularly thereafter, does not occur.

As described above, in the lighting condition of the discharge lamp 16, when the detection voltage detected by $V_{CE}$ detection circuit 40 becomes high, the ON-time for switching transistor Q1 is shortened so that control circuit 30 for setting $V_{CE}$ constant lowers the output voltage from inverter circuit 20, whereas the $V_{CE}$ detection voltage becomes low, the switching transistor Q1 is subjected to the negative feedback control, thus controlling the voltage $V_{CE}$ to the constant level. Further, in the start-up operation of the discharge lamp 16, the constant control level of the voltage $V_{CE}$ is raised and kept at the raised level until the control circuit 30 receives a signal which is output from the timer circuit 50 when a preset period of time has elapsed in the start-up operation. Thus, the output voltage of the inverter circuit 20 is set at a high level so that the discharge lamp 16 can be easily started. Further, when the timer circuit 50 outputs a signal after a preset period of time or when the discharge lamp 16 is lit, the control circuit 30 is set to control the voltage $V_{CE}$ to the preset constant level.

Figure 4:
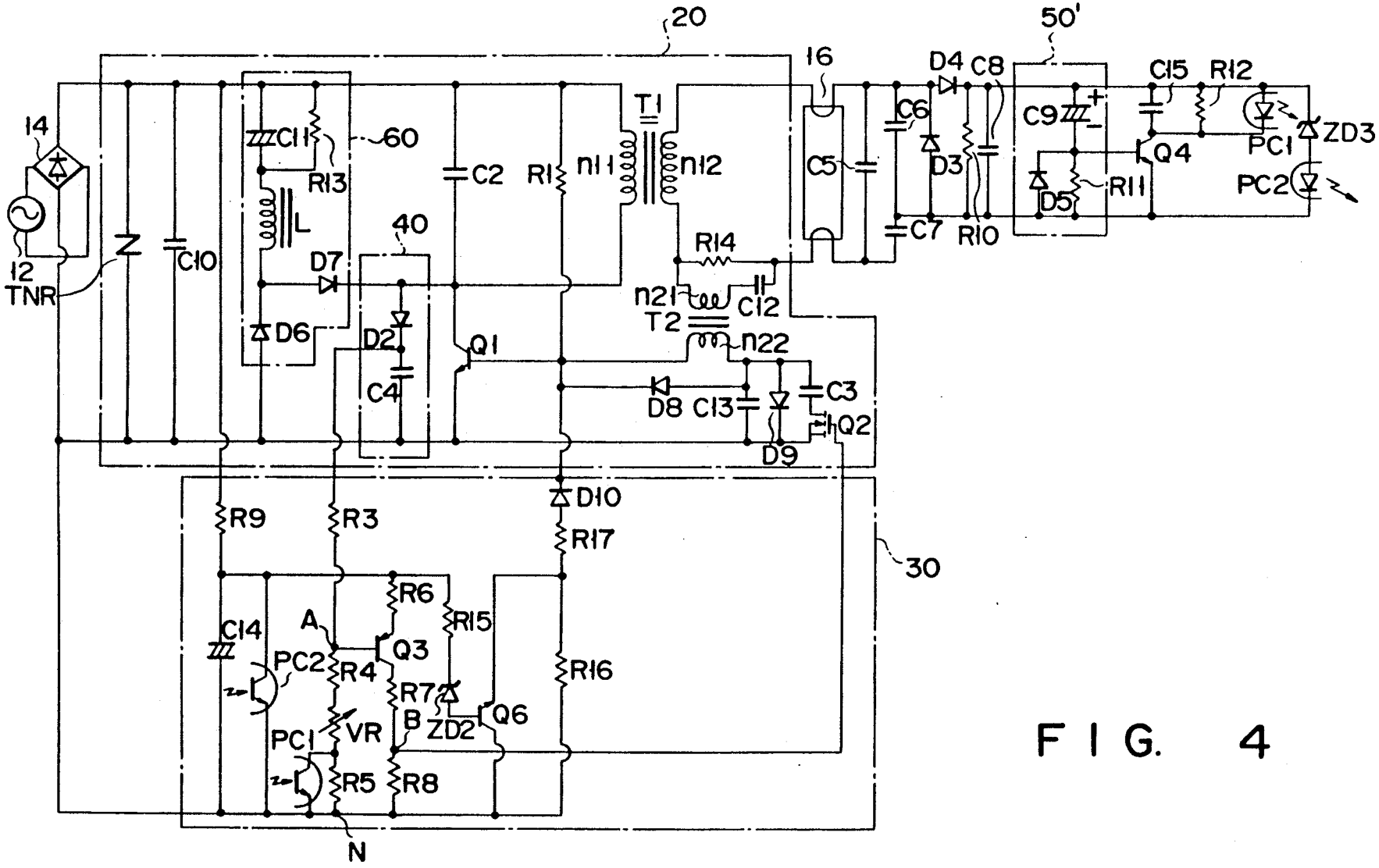
FIG. 4 is a circuit diagram showing the construction of a discharge lamp lighting apparatus using an inverter according to another embodiment of this invention.

FIG. 4 is a circuit diagram showing the construction of another embodiment of this invention. In FIG. 4, portions which are the same as those shown in FIG. 1 are denoted by the same reference numerals and the explanation thereof is omitted.

As shown in FIG. 4, a surge absorption circuit TNR and a capacitor C10 are connected in parallel between both rectification output terminals of a power source rectifier 14. Further, a parallel circuit of a capacitor C11 and a resistor R13 is connected in series with a inductor L and a diode D6 with the polarity as shown in FIG. 4 between the rectification output terminals of the power source rectifier 14. A diode D7 is connected in a forward direction between the anode of a diode D2 and the cathode of the diode D6. The capacitor C11, resistor R13, inductor L and diodes D6 and D7 constitute an auxiliary power source circuit 60. The auxiliary power source circuit 60 is charged in a period of time corresponding to the convex portion of a pulsating output voltage of the power source rectifier 14 and discharged in a period of time corresponding to the bottom portion of the pulsating output voltage so as to set the input voltage of the inverter circuit 20 nearer to a smoothed D.C. voltage.

A capacitor C12 is connected in series with the primary winding n21 of a saturable transformer T2 and a resistor R14 is connected in parallel with series circuit of the capacitor C12 and the primary winding n21. The secondary winding n22 is connected in parallel with a diode D8 with the polarity as shown in FIG. 4 and a capacitor C13 and a diode D9 are connected in parallel between the emitter of the switching transistor Q1 and the connection point between the secondary winding n22 and capacitor C3.

The base of the transistor Q6 is connected to the resistor R6 on the emitter side of the transistor Q3 of the control circuit 30 via a resistor R15 and a zener diode ZD2. A resistor R16 is coupled between the collector and emitter of the transistor Q6 and at the same time connected to the base of the switching transistor Q1 via a resistor R17 and a diode D10 with the polarity as shown in FIG. 4. Further, a parallel circuit of a capacitor C14 and a phototransistor of a photocoupler PC2 is coupled between the resistor R9 and the node N. In addition, a variable resistor VR is connected between the resistors R4 and R5.

A series circuit of a transistor Q4 and a light emitting diode of the photocoupler PC1 on the side of the timer 50' is connected in parallel with a series circuit of a zener diode ZD3 and a light emitting diode of the photocoupler PC2. Further, a capacitor C15 is connected in parallel with the resistor R12.

With the circuit of FIG. 4 constructed as described above, the photocoupler PC2 is used as a safety circuit. For example, the discharge lamp 16 functions as follows when a voltage across the discharge lamp 16 or a voltage across the series circuit of the zener diode ZD2 and the light emitting diode of the photocoupler PC2 becomes extremely high by half-wave discharge or the like.

When the light emitting diode of the photocouple PC2 is turned on, the phototransistor of the photocoupler PC2 is turned on and the transistor Q6 is turned off. The resistance of a discharging circuit constituted by the capacitors C3 and C12, resistors R16 and R17, diode D10, the secondary winding n22 of the saturable transformer T2, and capacitors C12 and C3 is increased by inserting the resistor R16 into the base circuit of the switching transistor Q1. As a result, a discharging amount of the capacitors C12 and C3 can be reduced and a charging current for charging the capacitors C12 and C3 in a period of time when the transistor Q1 is next turned on or a base current of the transistor Q1 is reduced, thus reducing the output of the inverter circuit 20.

In this invention, the timer circuit can be constructed in a desired form if it is operated in response to the start-up of the discharge lamp. For example, the timer can be provided on the input side of the inverter so as to respond to an input voltage.

Further, the control circuit for controlling the voltage $V_{CE}$ to the constant level can be variously modified.

What is claimed is:

1. A discharge lamp lighting apparatus comprising:

means for supplying a D.C. voltage;

means for switching said D.C. voltage provided by said D.C. voltage supplying means, said switching means being turned on and off at a predetermined frequency;

a parallel voltage resonance circuit, including an inductor and a capacitor, connected at a connection point in series with said switching means across said D.C. voltage supplying means;

means, connected to said connection point, for detecting a voltage of said switching means at said connection point; and control means for:

raising, independently from the lighting condition of the discharge lamp, the voltage of said switching means, detected by said voltage detection means, to a relatively high constant preset level in a predetermined period of time from the time at which said D.C. voltage supplying means is turned on, and setting the voltage of said switching means detected by said voltage detection means to a relatively low constant level after said predetermined period of time has elapsed.

2. A discharge lamp lighting apparatus comprising:

means for supplying a D.C. voltage;

means for switching said D.C. voltage provided by said D.C. voltage supplying means;

a parallel voltage resonance circuit, including an inductor and a capacitor, connected at a connection point in series with said switching means across said D.C. voltage supplying means;

means, connected to said connection point, for detecting a voltage of said switching means at said connection point, said voltage detection means comprising a series circuit, said series circuit comprising a detection diode and a detection capacitor coupled in parallel with said switching means, said voltage detection means detecting a voltage charged on said detection capacitor; and control means for raising the voltage of said switching means, detected by said voltage detection means, to a relatively high constant preset level in a predetermined period of time from the time at which said D.C. voltage supplying means is turned on until said discharge lamp is lit and setting the voltage of said switching means detected by said voltage detection means to a relatively low constant level after said discharge lamp is lit.

3. A discharge lamp lighting apparatus comprising:

means for supplying a D.C. voltage;

means for switching said D.C. voltage provided by said D.C. voltage supplying means, said switching means comprising a switching transistor;

a parallel voltage resonance circuit, including an inductor and a capacitor, connected at a connection point in series with said switching means across said D.C. voltage supplying means;

means, connected to said connection point, for detecting a voltage of said switching means at said connection point, said voltage detection means detecting a voltage between a collector and emitter of said switching transistor; and control means for raising the voltage of said switching means, detected by said voltage detection means, to a relatively high constant preset level in a predetermined period of time from the time at which said D.C. voltage supplying means is turned on until said discharge lamp is lit and setting the voltage of said switching means detected by said voltage detection means to a relatively low constant level after said discharge lamp is lit.

4. A discharge lamp lighting apparatus comprising:

means for supplying a D.C. voltage;

means for switching said D.C. voltage provided by said D.C. voltage supplying means;

a parallel voltage resonance circuit, including an inductor and a capacitor, connected at a connection point in series with said switching means across said D.C. voltage supplying means;

means, connected to said connection point, for detecting a voltage of said switching means at said connection point;

timer means for counting time which has elapsed after said D.C. voltage supplying means is turned on and said discharge lamp is started; and control means for:

raising the voltage of said switching means, detected by said voltage detection means, to a relatively high constant preset level in a predetermined period of time from the time at which said D.C. voltage supplying means is turned on until said discharge lamp is lit, said predetermined period of time being a time required for the time counted by said timer means to reach a preset period of time, and setting the voltage of said switching means detected by said voltage detection means to a relatively low constant level after said discharge lamp is lit and after the time counted by said timer means has exceeded the preset period of time, wherein said control means and timer means include a photocoupler, and said control means controls the voltage of said switching means detected by said voltage detection means to a constant level by use of said photocoupler after the time counted by said timer means has exceeded a preset period of time.

5. A discharge lamp lighting apparatus comprising:

means for supplying a D.C. voltage, said D.C. voltage supplying means comprising an A.C. power source, a rectifier element, and an auxiliary power source circuit for setting a voltage supplied from said D.C. voltage supplying means nearer to a smoothed D.C. voltage;

means for switching said D.C. provided by said D.C. voltage supplying means;

a parallel voltage resonance circuit, including an inductor and a capacitor, connected at a connection point in series with said switching means across said D.C. voltage supplying means;

means, connected to said connection point, for detecting a voltage of said switching means at said connection point;

timer means for counting time which has elapsed after said D.C. voltage supplying means is turned on and said discharge lamp is started; and control means for:

raising the voltage of said switching means, detected by said voltage detection means, to a relatively high constant preset level in a predetermined period of time from the time at which said D.C. voltage supplying means is turned on until said discharge lamp is lit, said predetermined period of time being a time required for the time counted by said timer means to reach a preset period of time, and setting the voltage of said switching means detected by said voltage detection means to a relatively low constant level after said discharge lamp is lit and after the time counted by said timer means has exceeded the preset period of time.

6. An apparatus according to claim 1, wherein said voltage detection means further includes a voltage-dividing resistor coupled in parallel with said detection capacitor to divide the detection voltage.

7. An apparatus according to claim 6, wherein said control means includes a potential controlling transistor having a base coupled to a neutral point of said voltage-dividing resistor, an emitter coupled to a neutral point of a series circuit of a resistor and a zener diode connected between one end and the other end of said D.C. voltage supplying means and a collector coupled to the other end of said D.C. voltage supplying means and said switching means.

8. An apparatus according to claim 4, wherein said timer means counts a course of time from when said discharge lamp is turned on by integrating voltage generated between terminals of said discharge lamp after rectifying and smoothing said voltage.

* * * * *